US008777348B2

(12) United States Patent
Bergstedt et al.

(10) Patent No.: US 8,777,348 B2
(45) Date of Patent: Jul. 15, 2014

(54) FIRE PULSE CIRCUIT AND METHOD OF USE

(75) Inventors: Steven Bergstedt, Winchester, KY (US); Ian Tomblinson, Louisville, KY (US)

(73) Assignee: Funai Electric Co., Ltd., Osaka (JP)

( * ) Notice: Subject to any disclaimer, the term of this patent is extended or adjusted under 35 U.S.C. 154(b) by 528 days.

(21) Appl. No.: 13/036,645

(22) Filed: Feb. 28, 2011

(65) Prior Publication Data

US 2012/0218334 A1 Aug. 30, 2012

(51) Int. Cl.
*B41J 29/38* (2006.01)
*B41J 2/045* (2006.01)

(52) U.S. Cl.
CPC ..... *B41J 2/0451* (2013.01); *B41J 2/04541* (2013.01); *B41J 2/0458* (2013.01); *B41J 2/04588* (2013.01)
USPC ..... 347/11

(58) Field of Classification Search
CPC .... B41J 2/0451; B41J 2/04541; B41J 2/0458; B41J 2/04588
USPC ..... 347/10, 11, 61, 62
See application file for complete search history.

(56) References Cited

U.S. PATENT DOCUMENTS 5,742,307 A * 4/1998 Watrobski et al. ..... 347/62
7,635,174 B2 * 12/2009 Bergstedt et al. ..... 347/9
8,138,775 B2 * 3/2012 Tomblinson ..... 324/750.01

* cited by examiner

*Primary Examiner* — An Do
(74) *Attorney, Agent, or Firm* — Amster, Rothstein & Ebenstein LLP

(57) ABSTRACT

A fire pulse circuit for use in an inkjet printer includes an input control signal transmitted from a controller to a logic AND gate and to fire truncation logic; fire truncation logic adapted to truncate a pulse width of the input control signal to a maximum allowable pulse width if the duration of the pulse exceeds a maximum allowable time; a logic AND gate that receives inputs from both the input control signal and the fire truncation logic to produce an output fire pulse signal that operates to optimally fire an inkjet heater driver logic to heat the heater to nucleate ink from the print head. The circuit is formed from either a combination of digital and analog components or from exclusively digital components. A method of using the circuit to generate an output fire pulse to an inkjet heater driver logic is also disclosed.

21 Claims, 3 Drawing Sheets

FIRE PULSE CIRCUIT AND METHOD OF USE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates generally to printers. More particularly, the present invention relates to ink jet printers having a fire pulse circuit that limits the width of any fire pulses that are deemed to be potentially damaging for a designed heater.

2. Description of the Related Art

Inkjet print heads require well-controlled timing of firing pulses entering a print head having an inkjet heater to maintain a consistent ink viscosity and jetting performance. CMOS thermal inkjet printers are actuated by data signals entering the print head. The current through an inkjet heater is controlled by a high power field effect transistor (power FET) that is actuated by a print head controller. When the power FET is given the correct input voltage pulse on its gate terminal the inkjet heater is able to nucleate the ink in a heater chamber and emit a drop from the nozzle. It is important that the heater receives the appropriate amount of energy in the form of a fire pulse to heat the heater enough to nucleate the ink without damaging the heater.

If the power FET receives an incorrect and excessive fire pulse duration then a heater receiving an excessive fire pulse may be physically damaged. Once the heater is damaged, the heater will no longer print properly or the heater will lose the ability to print, resulting in a noticeable loss of print quality from the printer.

SUMMARY OF THE INVENTION

A fire pulse circuit and method of use is generally provided for use in an inkjet printer to prevent damage to a heater within the printer.

In an embodiment of the invention, the circuit includes an input control signal transmitted from a controller to a logic AND gate and to fire truncation logic; fire truncation logic adapted to truncate a pulse width of the input control signal to a maximum allowable pulse width if the duration of the pulse exceeds a maximum allowable time; a logic AND gate that receives inputs from both the input control signal and the fire truncation logic to produce an output fire pulse signal that operates to optimally fire an inkjet heater driver logic to heat the heater to nucleate ink from the print head. The circuit is formed from either a combination of digital and analog components or from exclusively digital components.

In an embodiment of the invention a fire pulse circuit for a heater element of an inkjet printhead, includes: an input node to receive an input control signal having a first pulse width; a plurality of resistor elements combined to form a total resistance (R); a NMOS FET configured as a capacitor (C), wherein the total resistance and the capacitor define an RC circuit having a time constant to truncate the first pulse width of the input control signal only if the duration of the first pulse width exceeds a maximum allowable time; and logic components to receive input from the RC circuit to produce an output fire signal having a second pulse width shorter than the first pulse width that operates to optimally control the heater element to nucleate ink from the printhead.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DESCRIPTION OF THE INVENTION

Figure 1:
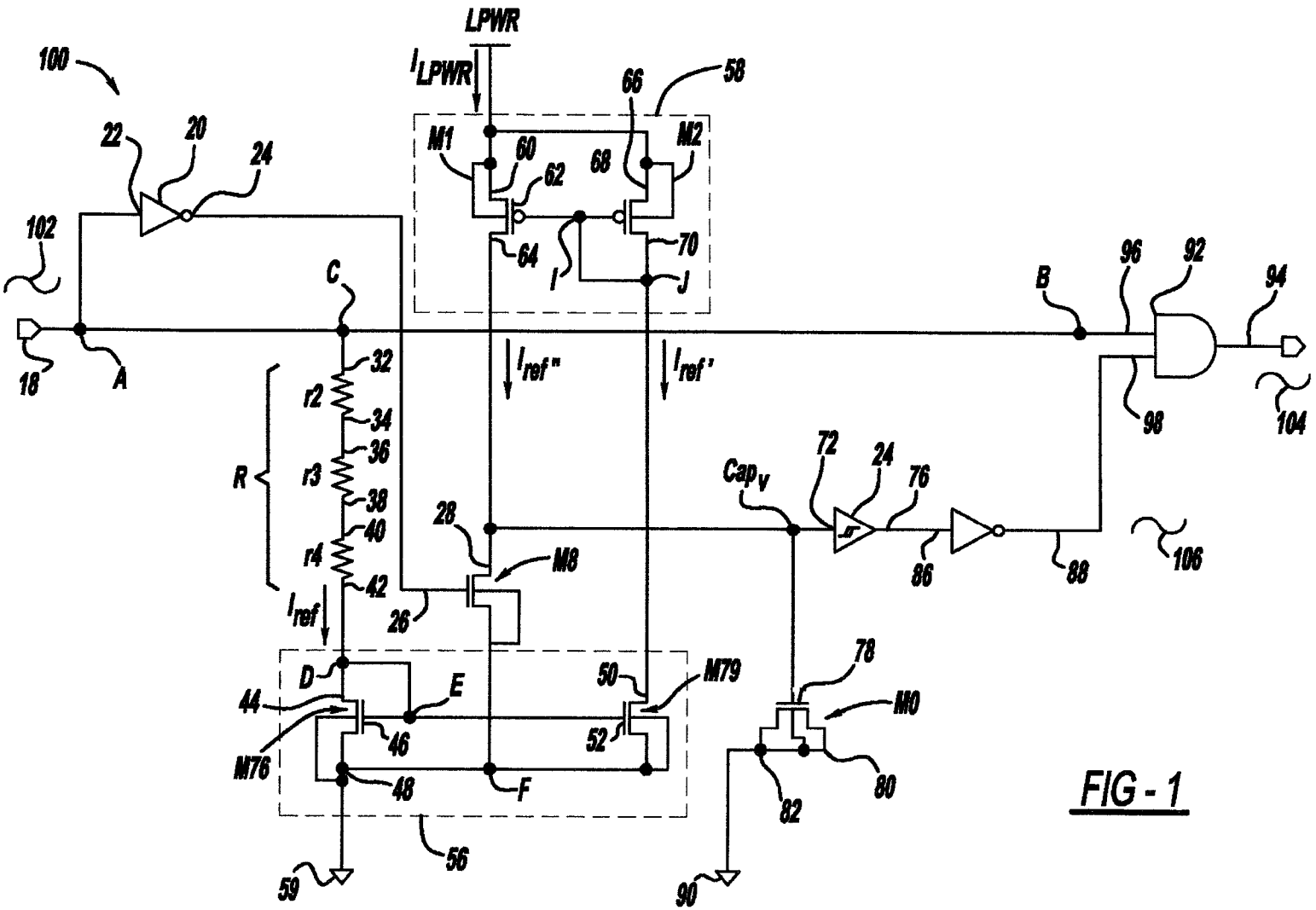
FIG. 1 is a diagrammatic depiction of a schematic of an exemplary fire pulse circuit in accordance with an embodiment of the invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware.

The invention generally includes a fire pulse circuit that controls actuation pulses to an inkjet heater so that the heater is able to optimally nucleate the ink in the chamber and emit a drop from the nozzle without damaging the heater.

In one embodiment, the print head chip includes a print head controller or inkjet heater driver that controls actuation of the heater and an integral fire pulse circuit including a control fire input pulse signal to the chip and fire truncation logic that derives a fire truncation signal from the single control input pulse signal and outputs an output fire pulse signal that operates the inkjet heater driver logic to nucleate the ink in the heater chamber and emit a drop from the nozzle. Outputs of the fire pulse circuitry provide input to the inkjet heater driver logic.

The print head controller includes a processor unit and associated memory, and may be formed as one or more Application Specific Integrated Circuits (ASIC). Memory may be, for example, random access memory (RAM), read only memory (ROM), and/or non-volatile RAM (NVRAM). Alternatively, memory may be in the form of a separate electronic memory (e.g., RAM, ROM, and/or NVRAM), a hard drive, a CD or DVD drive, or any memory device convenient for use with controller. Controller may be, for example, a combined printer and scanner controller.

In an embodiment, the fire pulse circuitry includes include MOSFET logic, and a logic AND gate or a logic NAND gates with an inverter.

Control waveforms with a input pulses from the controller that exceed a predefined maximum allowable design limit will be truncated in order to preserve the integrity of the heater materials. The invention increases heater reliability and the life of the print head for inkjet printers. The circuitry of the invention may include a mixed signal circuit including both analog and digital devices or alternatively, may include a fully digital circuit.

Starting at an input pin to a print head chip, a controller produces an input control signal having an initial pulse width (first pulse width) is distributed to three nodes in the truncation circuit: a first node (input node) A coupling the input control signal pulse to an inverter, a second node B coupling the control fire signal to a logic AND gate, and a third node C coupling the control fire signal to at least one resistor. The input control signal is transmitted from the controller to a logic AND gate and to fire truncation logic. Fire truncation logic is adapted to truncate a pulse width of the input control signal to a maximum allowable pulse width if the duration of the pulse exceeds a maximum allowable time, and the logic AND gate that receives inputs from both the input control signal and the fire truncation logic produce an output fire pulse signal that operates to optimally fire an inkjet heater driver logic to heat the heater to nucleate ink from the print head.

The fire truncation logic further includes a capacitive element, wherein the at least one resistor having a total resistance R and the capacitive element form a RC circuit adapted to control fire pulse duration through the charging of the capacitive element. The RC circuit having a time constant to truncate the first pulse width of the input control signal only if the duration of the first pulse width exceeds a maximum allowable time Thus, the at least one resistor and the capacitive element determine the maximum allowable pulse width that the circuit will allow to pass.

In an embodiment of the invention, logic components receive inputs from the RC circuit to produce an output fire signal having a second pulse width shorter than the first pulse width that operates to optimally control the heater element to nucleate ink from the printhead.

In an embodiment of the invention, the capacitive element is a first NMOS FET configured as a capacitor C.

In an embodiment of the invention, a power source is coupled to the at least one resistor and the capacitive element to drive current from the power source into the capacitive element and to charge the capacitive element.

Figure 3A:
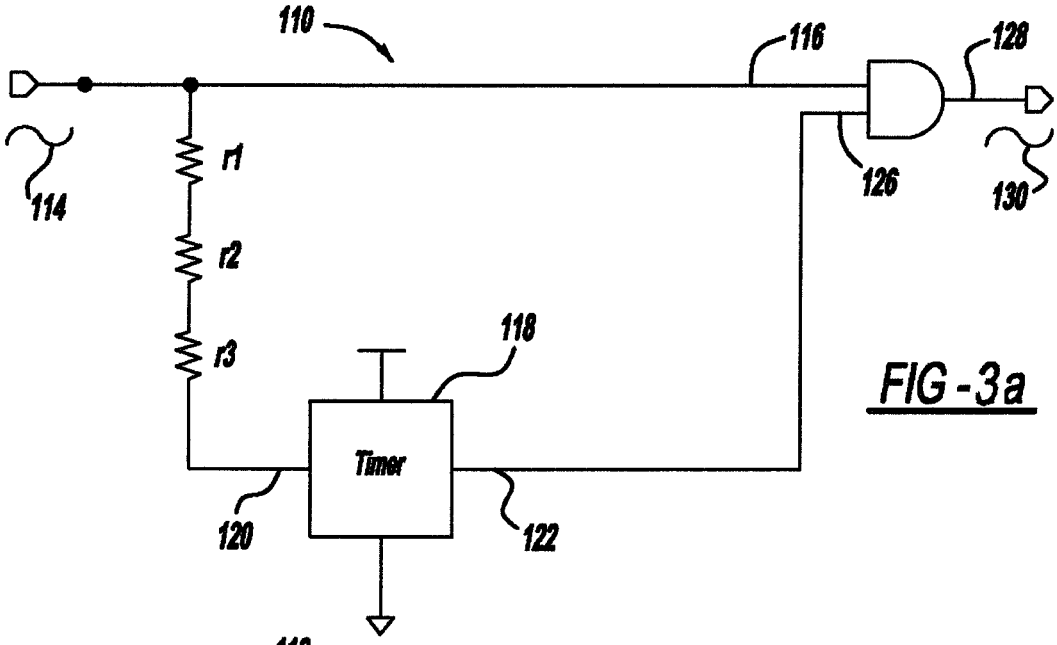
FIGS. 3*a*, 3*b* are diagrammatic depictions of two schematic of an exemplary fire pulse circuit including digital logic in accordance with two embodiments of the invention.
Figure 3B:
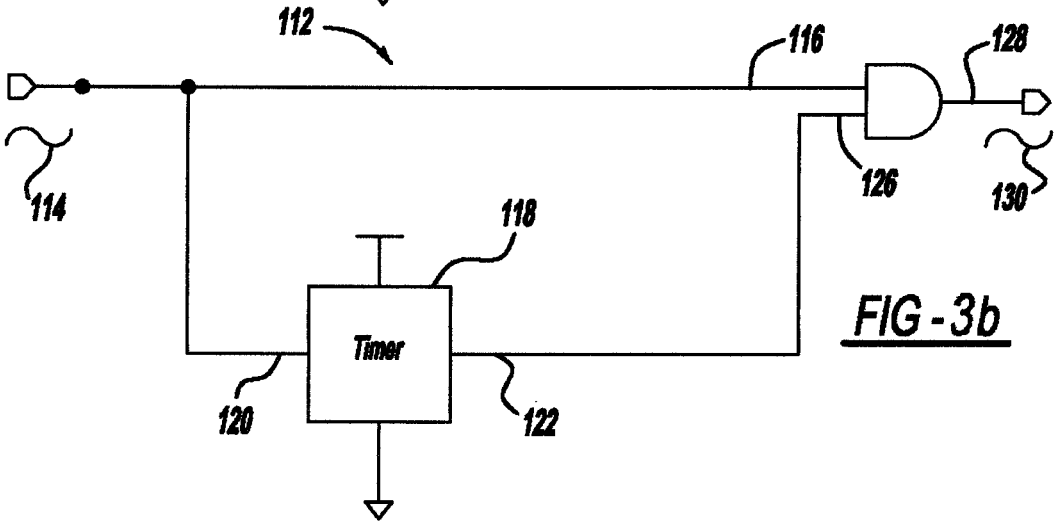
Figure 4:
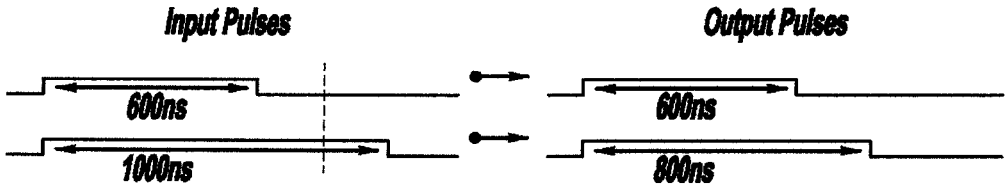
FIG. 4 is a diagrammatic depiction of two input pulses input into a fire pulse circuit and two output pulses output from the fire pulse circuit.

Several schematics illustrating three different embodiments of the invention are shown in FIGS. 1, 3-4 for a fire pulse circuit.

Referring in particular to the schematic shown in FIG. 1, a fire pulse circuit 100 is shown and includes an input control signal 102 input into pin 18 and into the inverter 20. The inverter 20 has a first input terminal 22 coupled to node A and a second output terminal 24 coupled to a gate terminal 26 of a NMOS FET M8. The NMOS FET M8 is further coupled to a NMOS FET M0, configured as a capacitor as described in more detail below.

The AND gate shown coupled to node B and to the input control signal is the final part of the fire pulse circuit 100 and operates to drive the inkjet heater fire logic or drivers. The first input terminal receives the input control signal as a first input transmitted from the controller, and the a second input terminal receives a truncation signal as a second input from the fire truncation logic. The third output terminal logically ANDs the first and second inputs to the AND gate first and the second input terminals to output a fire pulse output signal having a pulse width equal to or less than a maximum allowable pulse width.

When the pulse of the input control signal is low, the input to the fire circuit logic will always be low. When the pulse of the input control signal is high for an appropriate amount of time, the waveform going to the fire pulse circuit logic will he high as well. If the pulse of the input control signal is high for too long and exceeds a maximum allowable pulse width, then the fire truncation logic will assert the second terminal input at node 106 (trunc_n) of the AND gate to be low. This will cause the output to the to the inkjet heater driver logic to be low.

The third node (C) the "in" pin is couple to at least one resistor or a plurality of resistors forming a resistor stack as shown in FIG. 1. The at least one resistor R has a resistance that varies in response to-temperature changes within fire pulse circuit 100.

In an embodiment of the invention, each individual resistor (R2, R3, R4) is made of heater material, and thus, the pulse width control will vary with the sheet resistance of this material. As the resistance of the inkjet heaters and resistor material increases, a longer pulse width is needed to nucleate the ink. When impedance goes up in the fire truncation logic resistors, the allowable pulse width also increases. Thus, both the desired pulse width and the allowed pulse width will increase or decrease together as heater material sheet resistance changes in the wafer fabrication process. Thus, a maximum allowable signal pulse width is proportional to the resistance of the resistors in the resistor stack and increases as the resistance of the resistors increases.

In particular, the circuit 100 helps protect fragile thin film layers of heater resistors by limiting the amount of energy allowed to be introduced to the heater in each pulse. Using a resistor made of heater material makes the input control signal pulse truncation width limit track the sensitivity of heater stack and thereby allows for heater material process variation with minimized sensitivity. This feature allows use of heater materials that may require a specific operating window having a small range between the nucleation point for desired heater operation and the failure point for the inkjet heater thin films. Thus, the fire pulse circuit serves to increase reliability for inkjet heater chips.

In an embodiment of the invention, the at least one resistor R may be formed from one or more resistors as shown in FIG. 1, including resistor r2 having a first terminal 32 coupled to node A and a second terminal 34 coupled in series to a second resistor r3 having a first terminal 36 and a second terminal 38, wherein the second resistor r3 second terminal 38 is coupled to a third resister r4 having a first terminal 40 and a second terminal 42 coupled to node D. When a high control signal is input into the input pin 18, current flows through the resistors r2, r3, r4 into a first current minor 56 coupled to node D.

After the resistor stack, there are two current mirrors, a first current mirror M76, M79 and a second current mirror M1, M2 that are is used to direct current into the capacitive element to charge the capacitive element and to establish voltage levels at the capv node.

The first Mirror M76, M79 converts the fire pulse voltage of the control signal input into a current and scales the current to effectively increase the delay time for the capacitor to charge and further requires minimal layout space. Current mirrors created by M76, M79 and M1, M2 allow current to flow from a power source into the M0 capacitor to charge the capacitor. In operation, the Current mirror M1, M2 changes the current sink to a current source, thereby converting a falling edge of the control input pulse to a rising edge. When the control input pulse stays high for a duration longer than a maximum allowable pulse duration beyond the print head's design limits, the M0 capacitor becomes fully charged.

The first current minor includes two NMOS FETs M76, M79 each having a source terminal 44, 50, a second gate terminal 46, 52, and a third drain terminal 48, 54, wherein each of the drain terminals 48, 54 are coupled to node F and are respectively tied to ground 58. The source terminal 44 of FET M76 is tied to the gate terminal 46 of FET M76, thereby coupling nodes D and E and wherein gate terminal 46 of the FET M76 is further coupled to the gate terminal 52 of FET M79.

A second current mirror 58 is formed by two PMOS FETS M1, M2, as shown in FIG. 1, each having a drain terminal 60, 66, a second gate terminal 62, 68, and a third source terminal 64, 70, wherein each of the drain terminals 60, 66 are coupled to node H and are further coupled to and powered by reference source. The gate terminal 68 of FET M2 is tied to the source terminal 70 of FET M2, thereby coupling nodes I and J and wherein gate terminal 62 of the FET M1 is further coupled to the gate terminal 68 of FET M2. The source terminal 70 of FET M2 is coupled to the source terminal 50 of FET M79 thereby providing current $I_{ref}$ into FET M79. Additionally, the source terminal 64 of FET M1 is coupled to gate terminal 78 of FET M0 via node K such that current $I_{ref}$" flows into the capacitive element of FET M0.

The source terminal 28 of FET M8 is coupled to node cap, and provides a voltage input into a Schmitt Trigger 24 having an input terminal 72 and an output terminal 76. The Schmitt Trigger output terminal 76 is coupled to a second inverter 84 having an input terminal 86 and an output terminal 88 coupled to a second terminal of an AND gate, wherein the source terminal 28 of FET M8 is further coupled to an NMOS FET M0 configured as a capacitor having a first gate terminal 78, a second source terminal 80 tied to ground 90, and a third drain terminal 82 tied to ground, wherein a capacitance C is formed by a junction between the gate terminal 78 of device capacitor M0 and ground 90.

With M0 fully charged, the cap, node reaches a high potential. Once capacitor charged to the voltage level to trigger Schmitt trigger at a maximum allowable pulse duration. The capacitive element charges at a linear rate.

As a result, the output of the Schmitt trigger is a low-going pulse which stays in the low state until a threshold voltage at the capv node is reached. A final inverter then inverts the signal prior to being applied to the logic AND gate.

This waveform is then input to the second AND terminal to shorten the width of the input control pulse as the—pulse width increases beyond the maximum allowable pulse width.

Figure 2:
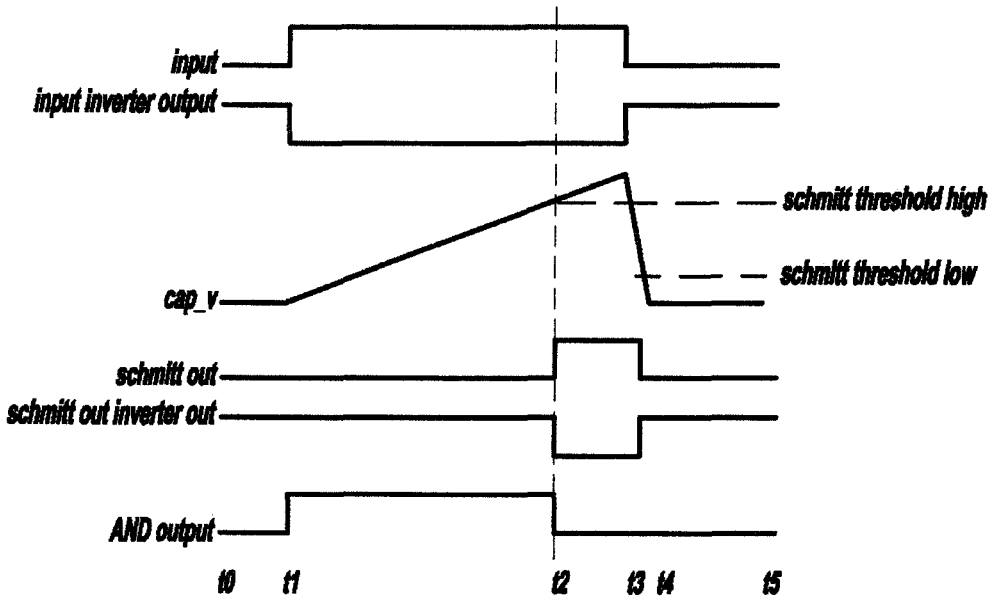
FIG. 2 is a diagrammatic depiction of a timing diagram illustrating operation of the exemplary fire pulse circuit shown in FIG. 1.

FET M8 is placed on the cap, node so that a negative edge on the fire pulse will immediately start to pull the Schmitt trigger input back to a low state (as shown in more detail in the timing diagram illustrated in FIG. 2 at time t2). Thus, FET M8 allows the charge on M0 to deplete quickly, causing there to be no charge storage for the capacitive element. This capability provides reliability of the circuit during high frequency, high duty cycle testing or printing operations.

The cap, node drives a Schmitt trigger which helps isolate the output of the truncation circuit from any noise on the cap, node and will also help isolate the circuit from the effects of ground potential shift during heavy fire current situations. The Schmitt output is inverted to give a trunc_n signal input into the second input terminal of the AND gate. As stated previously, the AND gate is the final stage of the truncation circuit and drives into the inkjet heater driver logic. When M0 becomes fully charged the $cap_v$ node drives a high signal into the Schmitt trigger, which results in a low signal being driven at trunc_n.

FIG. 2 illustrates a timing diagram illustrating the operation of the fire pulse circuit 100 as shown in FIG. 1. Initially, a control fire input pulse signal 102 is input into a first terminal 96 of AND gate 92 and is low at time $t_0$. At time $t_0$, an input signal is low at node A and is inverted to a high output from the first inverter 20 from output terminal 24 as no current flows through resistors r2, r3, r4. Also at time $t_0$, no current flows into the capacitive element of FET M0 via the first and second current minors 56, 58 and thus, the voltage at time $t_0$ at node $cap_v$ is also low. The output of the Schmitt Trigger 24 at time $t_0$ is also low and is inverted to a high output from second inverter 84 to the second terminal 98 of AND gate 92. At time $t_0$, the input signals into terminals 96, 98 of the AND gate 92 include a control fire input pulse signal 102 and a modified control fire input pulse signal 106, and produce from the AND output terminal 94 output fire pulse signal 104 as shown in FIG. 2.

At time $t_1$, the control fire input pulse signal 102 is input into the first terminal 96 of AND gate 92 and is high. Until time $t_2$, an input signal is high at node A and is inverted to a low output from the first inverter 20 from output terminal 24 as a current $I_{ref}$ flows through resistors r2, r3, r4. Also until time $t_2$, a current $I_{ref}$ flows into the capacitive element of FET M0 via the first and second current mirrors 56, 58 and thus, the voltage at node $cap_v$ increases linearly until time $t_2$. Until time $t_2$, the output of the Schmitt Trigger 24 remains low and is inverted to a high output from second inverter 84 to the second terminal 98 of AND gate 92. At time $t_1$, the input signals into terminals 96, 98 of the AND gate 92 include a control fire input pulse signal 102 and a modified control fire input pulse signal 106, and produce from the AND output terminal 94 output fire pulse signal 104 as shown in FIG. 2.

At time $t_2$, the control fire input pulse signal 102 is input into the first terminal 96 of AND gate 92 and is high. At time $t_2$, an input signal is high at node A and is inverted to a low output from the first inverter 20 from output terminal 24 as a current $I_{ref}$ flows through resistors r2, r3, r4. Also at $t_2$, a current $I_{ref}$ flows into the capacitive element of FET M0 via the first and second current mirrors 56, 58 and thus, the voltage at time $t_2$ at node $cap_v$ is at a threshold voltage shown as Schmitt threshold high. At time $t_2$, the output of the Schmitt Trigger 24 is also high and is inverted to a low output from second inverter 84 to the second terminal 98 of AND gate 92. At time $t_2$, the input signals into terminals 96, 98 of the AND gate 92 include a control fire input pulse signal 102 and a modified control fire input pulse signal 106 (trunc_n), and produce from the AND output terminal 94 output fire pulse signal 104 as shown in FIG. 1 and as AND output in FIG. 2.

At time $t_3$, the control fire input pulse signal 102 is input into the first terminal 96 of AND gate 92 and is low. At time $t_3$, an input signal is low at node A and is inverted to a high output from the first inverter 20 Also at $t_3$, no current flows into the capacitive element and thus, the voltage at time $t_3$ at node $cap_v$ is at Schmitt threshold low as shown in FIG. 2. At time $t_3$, the output of the Schmitt Trigger 24 is low and is inverted to a high output from second inverter 84 to the second terminal 98 of AND gate 92. At time $t_3$, the input signals into terminals 96, 98 of the AND gate 92 include a control fire input pulse signal 102 and a modified control fire input pulse signal 106, and produce from the AND output terminal 94 output fire pulse signal 104 as shown in FIG. 1 and the AND output in FIG. 2.

At time $t_4$, a control fire input pulse signal 102 is input into a first terminal 96 of AND gate 92 and is low. At time $t_4$, an input signal is low at node A and is inverted to a high output from the first inverter 20 from output terminal 24 as no current flows through resistors r2, r3, r4. Also at time $t_4$, no current flows into the capacitive element of FET M0 via the first and second current mirrors 56, 58 and thus, the voltage at time $t_4$ at node $cap_v$ is also low. The output of the Schmitt Trigger 24 at time $t_4$ is also low and is inverted to a high output from second inverter 84 to the second terminal 98 of AND gate 92. At time $t_4$, the input signals into terminals 96, 98 of the AND gate 92 include a control fire input pulse signal 102 and a modified control fire input pulse signal 106, and produce from the AND output terminal 94 output fire pulse signal 104 as shown in FIG. 1 and the AND output in FIG. 2.

At time $t_5$, the operation of the fire pulse circuit 100 is substantially the same as at time $t_0$.

FIG. 4 illustrates an example of two different pulse width signals input into the fire pulse circuit, one having a pulse width exceeding a maximum allowable pulse width, and one less than the maximum allowable pulse width. In an embodiment of the invention when a signal having a pulse width equal to or less than the maximum allowable pulse width is input into the fire pulse circuit, the same signal having an equal pulse width is output from the fire pulse circuit. In an embodiment of the invention when a signal having a pulse width exceeding the maximum allowable pulse width is input into the fire pulse circuit, a signal truncated to the maximum allowable pulse width is output from the fire pulse circuit.

In an embodiment of the invention, as shown in FIG. 4, a maximum allowable pulse width is 800 ns. A first signal has a pulse width of 600 ns, i.e. less than 800 ns is input into the fire pulse circuit and a signal having a pulse width of 600 ns is then output from the fire pulse circuit. A second signal has a pulse width of 1000 ns, i.e. exceeding 800 ns, is input into the fire pulse circuit and a truncated signal having a pulse width of 800 ns is then output from the fire pulse circuit.

Waveforms with a pulse width in excess of the specified pulse width limit are truncated at the specified limit. Thus, damage to the heater will be prevented.

As the schematic in FIG. 1 shows, this circuit uses both analog and digital parts to compose a mixed signal circuit. The circuit could be realized through only digital logic by simply counting clock cycles using a counter and registers.

FIGS. 3*a*, and 3*b* illustrate two embodiments of the invention using only digital logic for the fire truncation circuit. A fire pulse circuit 110 is shown in FIG. 3*a*, and a fire pulse circuit 112 is shown in FIG. 3*b*. Both circuits 110, 112 include control input signal 114 input into a first terminal 116 of the logic AND 124 gate and also couples the control input signal 114 to a timer 118 having an input terminal 120 that receives the input control signal 114 and an output terminal 122 that outputs a state of low or high to the logic AND gate 124 at a second AND gate terminal 126 depending on the duration of a pulse of the input control signal 114. Additionally, within the timer is an internal clock that triggers a counter or register upon receiving a leading edge of a pulse of the input control signal 114 and drives the state of the output of the output terminal by outputting a high state when the pulse has a duration equal to or less than a maximum allowable pulse duration and a low when the pulse of the input control signal is low or when the duration of the input control signal exceeds the maximum allowable pulse duration. The AND gate output terminal 128 then outputs signal 130 as an output fire pulse to fire the heater driver logic.

FIG. 3*a* additionally couples the timer to a node A via a plurality of resistors coupled in series between the input control signal and the timer 118, wherein each of the plurality of resistors r1, r2, r3 have an associated resistance that is used to determine a maximum allowable pulse width.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A fire pulse circuit comprising:

a input control signal transmitted from a controller to a logic AND gate and to fire truncation logic;

fire truncation logic to truncate a pulse width of the input control signal to a maximum allowable pulse width if the duration of the pulse exceeds a maximum allowable time; and a logic AND gate that receives inputs from both the input control signal and the fire truncation logic to produce an output fire pulse signal that operates to optimally fire an inkjet heater driver to heat the heater to nucleate ink from the print head.

2. The fire pulse circuit of claim 1 wherein the AND gate comprises:

a first input terminal that receives the input control signal as a first input transmitted from a controller, a second input terminal that receives a truncation signal as a second input from the fire truncation logic, a third output terminal that logically ANDs the first and second inputs to the AND gate first and the second input terminals to output a fire pulse output signal having a pulse width equal to or less than a maximum allowable pulse width.

3. The fire pulse circuit of claim 1 wherein the fire truncation logic comprises: at least one resistor; and a capacitive element, wherein the at least one resistor and the capacitive element form a RC circuit adapted to control fire pulse duration.

4. The fire pulse circuit of claim 3 further comprising:

a power source coupled to the at least one resistor and the capacitive element to drive current from the power source into the capacitive element and to charge the capacitive element.

5. The fire pulse circuit of claim 3 wherein the capacitive element comprises:

a junction between a gate and a source of a first NMOS FET having capacitance of Cgs.

6. The fire pulse circuit of claim 5 further comprising:

a power source coupled to the at least one resistor and the source of the first NMOS FET via at least one current minor to drive current from the power source into the source of the first NMOS FET and to charge the capacitive element.

7. The fire pulse circuit of claim 5 further comprising:

a first inverter coupled to the control input signal via a first node; a second node coupling the control input signal to the logical AND gate; and at least one resistor coupled to the control input signal via a third node.

8. The fire pulse circuit of claim 7 further comprising:

a power source; a first current mirror coupled to the at least one resistor; and a second current mirror coupled to the first current minor, to the power source and to the source of the first NMOS FET to drive current from the power source into the source of the first NMOS FET and to charge the capacitive element.

9. The fire pulse circuit of claim 8 further comprising:

a stack of resistors formed from three resistors coupled in series between the third node and the first current minor; and a power source coupled to the at least one resistor and the source of the first NMOS FET via at least one current minor to drive current from the power source into the source of the first NMOS FET and to charge the capacitive element.

10. The fire pulse circuit of claim 9 wherein the maximum allowable pulse width is proportional to the resistance of the resistors in the resistor stack.

11. The fire pulse circuit of claim 7, wherein the first inverter comprises:

an input terminal coupled to the control signal at the first node, and an output terminal coupled to the gate of the NMOS FET.

12. The fire pulse circuit of claim 7 further comprising:

a Schmitt trigger having an input terminal coupled to the source of the first NMOS FET at a fourth node and a second output terminal coupled to a second inverter; and a second inverter having a first input terminal coupled to the second output of the Schmitt trigger and a second output terminal coupled to the logic AND gate, wherein the Schmitt trigger is triggered when a voltage at the source of the first NMOS FET reaches a threshold voltage, wherein when triggered, the Schmitt trigger outputs a high signal to the input terminal of the second inverter.

13. The fire pulse circuit of claim 12 further comprising:

a second NMOS FET having a gate coupled to the source of the first NMOS FET at the fourth node and to the input terminal of the Schmitt trigger, wherein the second NMOS FET depletes charge from the capacitive element when a negative edge of a pulse of the control signal is transmitted to the fire pulse circuit.

14. The fire pulse circuit of claim 1 wherein the at least one resistor comprises: a resistance that increases as a pulse width of the control input pulse increases, wherein a maximum allowable pulse width is increased based on the resistance of the at least one resistor.

15. The fire pulse circuit of claim 1 wherein the at least one resistor comprises: a resistance that increases as a pulse width of the control input pulse increases.

16. The fire pulse circuit of claim 1 wherein the at least one resistor comprises:

a material formed from a same material used to form a heater element disposed within the print head.

17. The fire pulse circuit of claim 1 wherein the fire truncation logic comprises:

a timer having an input terminal that receives the input control signal, an output terminal that outputs a state of low or high to the logic AND gate depending on the duration of a pulse of the input control signal, and an internal clock that triggers a counter upon receiving a leading edge of a pulse of the input control signal and drives the state of the output of the output terminal by outputting a high state when the pulse has a duration equal to or less than a maximum allowable pulse duration and a low when the pulse of the input control signal is low or when the duration of the input control signal exceeds the maximum allowable pulse duration.

18. The fire pulse circuit of claim 17 wherein the fire truncation logic further comprising: a plurality of resistors coupled in series between the input control signal and the timer, wherein each of the plurality of resistors have an associated resistance that is used to determine a maximum allowable pulse width.

19. A method of controlling a fire pulse using a fire pulse circuit comprising:

inputting control signals having an input pulse width into a fire logic truncation circuit; and using the fire logic truncation circuit to truncate pulses more than a maximum pulse width to a maximum allowable pulse width; wherein the input pulse widths equal to or less than the maximum allowable pulse width are not modified by the fire logic truncation circuit and are output by the fire logic truncation circuit as an output fire pulse signal having a same pulse width as the input pulse width.

20. The method of claim 19 further comprising:

including a plurality of resistors in the fire logic truncation circuit; and adaptively modifying the maximum allowable pulse width based upon the resistance of the resistors.

21. A fire pulse circuit for a heater element of an inkjet printhead, comprising:

an input node to receive an input control signal having a first pulse width;

a plurality of resistor elements combined to form a total resistance (R);

a NMOS FET configured as a capacitor (C), wherein the total resistance and the capacitor define an RC circuit having a time constant to truncate the first pulse width of the input control signal only if the duration of the first pulse width exceeds a maximum allowable time; and logic components to receive input from the RC circuit to produce an output fire signal having a second pulse width shorter than the first pulse width that operates to optimally control the heater element to nucleate ink from the printhead.

* * * * *